US007997844B2

(12) United States Patent
Abegglen et al.

(10) Patent No.: US 7,997,844 B2
(45) Date of Patent: Aug. 16, 2011

(54) METHOD OF PRODUCING PERFECT-BOUND PRINTED PRODUCTS FORMED FROM SEVERAL PRINTED PRODUCTS AND INSTALLATION FOR PRODUCING PERFECT-BOUND PRINTED PRODUCTS

(75) Inventors: Christian Abegglen, Frauenfeld (CH); Theo Hug, Wallenwil (CH); Christophe Vaucher, Frauenfeld (CH); Konrad Boos, Sirnach (CH)

(73) Assignee: Müller Martini Holding AG, Hergiswil (CH)

( * ) Notice: Subject to any disclaimer, the term of this patent is extended or adjusted under 35 U.S.C. 154(b) by 779 days.

(21) Appl. No.: 11/983,131

(22) Filed: Nov. 6, 2007

(65) Prior Publication Data

US 2008/0260497 A1 Oct. 23, 2008

(30) Foreign Application Priority Data

Nov. 6, 2006 (EP) ..... 06 405 467

(51) Int. Cl.
*B42C 13/00* (2006.01)
*B42C 9/00* (2006.01)
*B42B 5/00* (2006.01)

(52) U.S. Cl. ..... 412/11; 412/8; 412/13; 412/14; 412/33; 412/37

(58) Field of Classification Search ..... 412/8, 11, 412/13, 14, 33, 37, 900, 901
See application file for complete search history.

(56) References Cited

U.S. PATENT DOCUMENTS 6,698,743 B2 * 3/2004 Kuramoto et al. ..... 412/8
7,568,687 B2 * 8/2009 Sasamoto ..... 412/11

FOREIGN PATENT DOCUMENTS

| | | |
|---|---|---|
| EP | 0 337 315 | 10/1989 |
| EP | 0 337 315 | 1/1994 |
| EP | 1 351 873 | 7/2002 |
| JP | 62016983 | 1/1987 |
| JP | 2006064885 A * | 3/2006 |

* cited by examiner

*Primary Examiner* — Shelley Self
*Assistant Examiner* — Justin V Lewis
(74) *Attorney, Agent, or Firm* — Lucas & Mercanti, LLP; Klaus P. Stoffel

(57) ABSTRACT

A method of producing perfect-bound printed products formed from several printed products, includes feeding printed products, which are gathered to form loose book blocks, are fed by feeders, which are arranged along a conveying line and are driven at least approximately with synchronous timing, to a conveyance device that has receiving devices that follow one another at regular intervals, and are transferred by this conveyance device into a gluing machine. The gluing machine, which is arranged downstream of the conveyance device and also has a conveying function, is run until it is empty in the event of an interruption of a processing operation by discontinuing further feeding of printed products to the receiving devices of the conveyance device and further feeding of loose book blocks to the gluing machine while the gluing machine is emptying.

9 Claims, 7 Drawing Sheets

METHOD OF PRODUCING PERFECT-BOUND PRINTED PRODUCTS FORMED FROM SEVERAL PRINTED PRODUCTS AND INSTALLATION FOR PRODUCING PERFECT-BOUND PRINTED PRODUCTS

BACKGROUND OF THE INVENTION

1. Field of the Invention

The present invention relates to a method of producing perfect-bound or adhesive-bound printed products formed from several printed products, wherein the printed products, which are gathered to form loose book blocks, are fed by means of feeders, which are arranged along a gathering line and are driven at least approximately with synchronous timing, to a conveyance device that has receiving devices that follow one another at regular intervals, and are transferred by this conveyance device into a gluing machine, wherein the event of an interruption of a processing operation, the gluing machine, which is arranged downstream of the conveyance device and also has a conveying function, is run until it is empty.

2. Description of the Related Art

The purpose of book production lines is to gather printed products in the correct order with a gathering machine and then to bind them into book blocks in a gluing machine. If the gathering machine is stopped, the gluing machine should continue to run at least until all of the book blocks present in the conveying clamps of the gluing machine have been processed into crudely bound books. This is necessary, because otherwise the adhesive applied in the spine area of the book block would set and the covers would no longer adhere. In accordance with the prior art, the signatures that have been loosely gathered into book blocks are conveyed by the gathering machine into the gluing machine by means of a so-called separating element, such that the separating element is in a synchronous driving connection with the gluing machine. With each machine cycle, a book block is conveyed by the gathering machine into the gluing machine. If the gathering machine is stopped, the synchronism with the gluing machine is lost, and each additional book block conveyed during the interruption would lead to disturbances in the conveyance into the gluing machine. In installations running at a high speed, in order to be able to uncouple the gathering machine from the gluing machine and brake it, it is therefore necessary first to slow down the entire line to a speed at which trouble-free uncoupling is possible. For this reason, in a design of this type for braking the gathering machine, a braking distance is available which corresponds to the spacing between the book blocks. Again, this can lead to disruptions of the gluing machine.

Another disadvantage manifests itself when the gathering machine, due to a failure of a feeder, must be uncoupled from the gluing machine and stopped. During the entire discharge phase of the gathering machine, several defective book blocks occur downstream of the feeder that is causing the failure and cannot be allowed to be conveyed into the gluing machine in this state. Two methods are known for accomplishing this: All defective book blocks between the gathering machine and the gluing machine are discharged or repaired. Discharging the book blocks has the disadvantage that the unbound book blocks must be taken apart manually or mechanically, sorted into the original printed products, and fed back into the corresponding feeders. If the defective book blocks are repaired in the stopped gathering machine, the repairs can be made manually. Furthermore, during this manual work, production cannot be carried on.

EP 0 337 315 B1 proposes that loose defective book blocks be transferred to a return device by a deflecting device, and that the book blocks then be broken down at least partially into printed products in a separating device.

SUMMARY OF THE INVENTION

It is the object of the present invention to uncouple the gathering machine at a high production speed from the gluing machine in a book production line and to resume production at the point of interruption.

In accordance with the invention, the solution to this problem is characterized by the fact that while the gluing machine is emptying, further feeding of printed products to the receiving devices of the conveyance device and further feeding of loose book blocks to the gluing machine are stopped.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
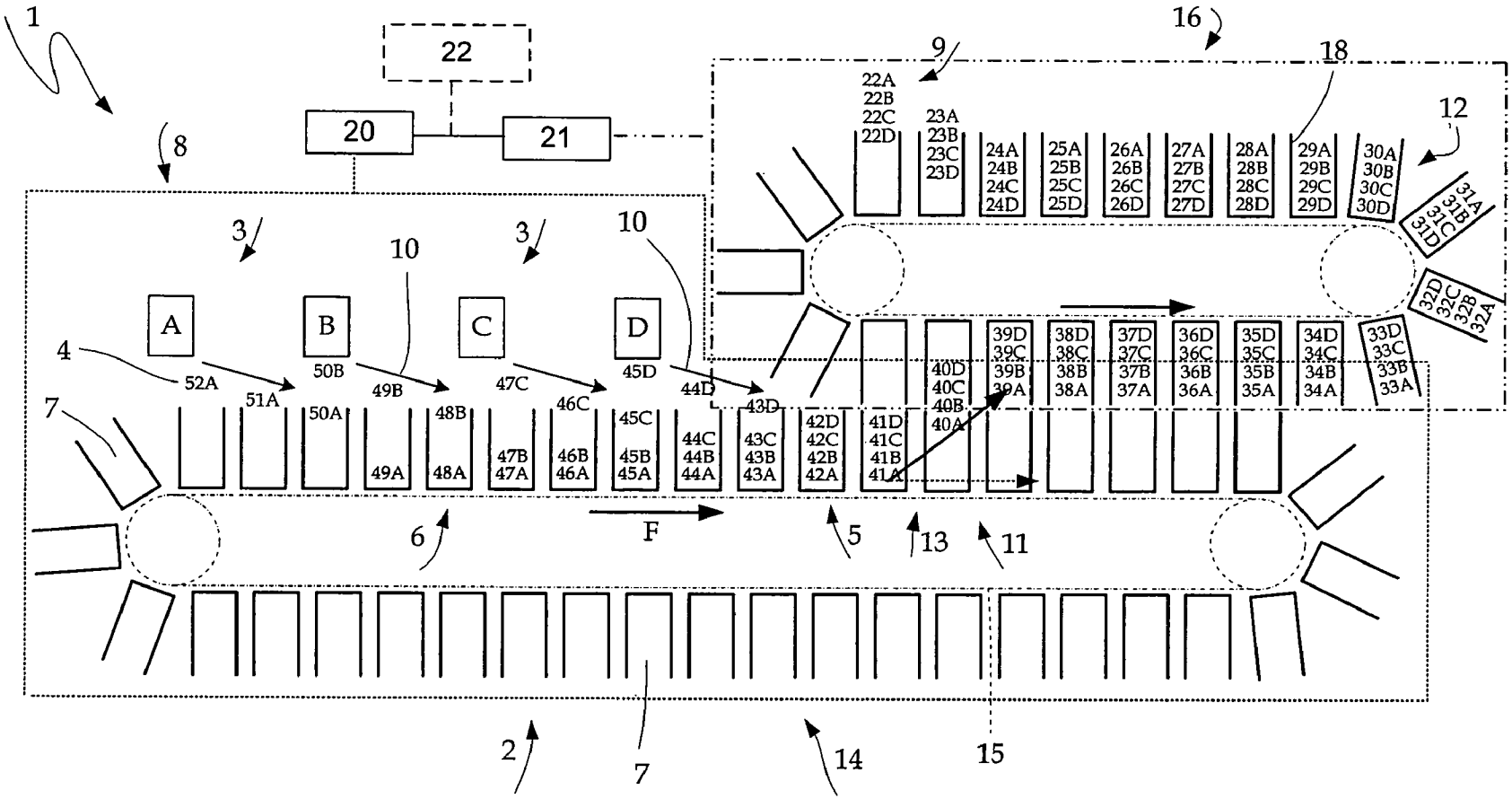
FIG. 1 is a schematic representation of a book production line during production.

FIG. 1 shows a book production line 1, which consists of a gathering machine 8 for gathering printed products 4 into loose book blocks 5, with a conveyance device 2, which has a conveying line 6 and a return line 14, and a gluing machine 16, in which the loose book blocks 5 are processed into crudely bound books, brochures, book blocks or similar types of printed products 9 by gluing the signatures at the spines. To receive and convey the printed products 4, the conveyance device 2 has receiving devices 7 that follow one another at regular intervals and are guided on a closed revolving track 15. A receiving device 7 is formed, for example, by a catch and a stationary channel, through which the catch pushes the printed products 4, or by a revolving compartment, on which the printed products 4 are gathered. Feeders 3, which are arranged along the conveying line 6 and are driven synchronously with the conveyance device 2, are provided for feeding printed products 4 to the receiving devices 7. To this end, each feeder is usually fed with one type of printed product 4. Each feeder 3 has means for the timed individual separation and feeding of the printed products 4 supplied in its magazine and a conveyor 10 for conveying the printed products 4 into the receiving devices 7 of the conveyance device 2 that are passing by. The conveyance device 2 is driven by a drive, not shown. The feeders 3 are driven by another, common drive, not shown, or, in a preferred embodiment, each feeder 3 is driven by its own drive. To ensure properly timed transfer of the printed products 4 into the receiving devices 7 of the conveyance device 2, the drive or drives of the feeders 3 are synchronously coupled with the drive of the conveyance device 2. Since each receiving device 7 within the conveying line 6 moves past each feeder 3, each feeder 3 can feed it with one of each printed product 4, so that at the end of the conveying line 6, it contains a complete loose book block 5.

Figure 7:
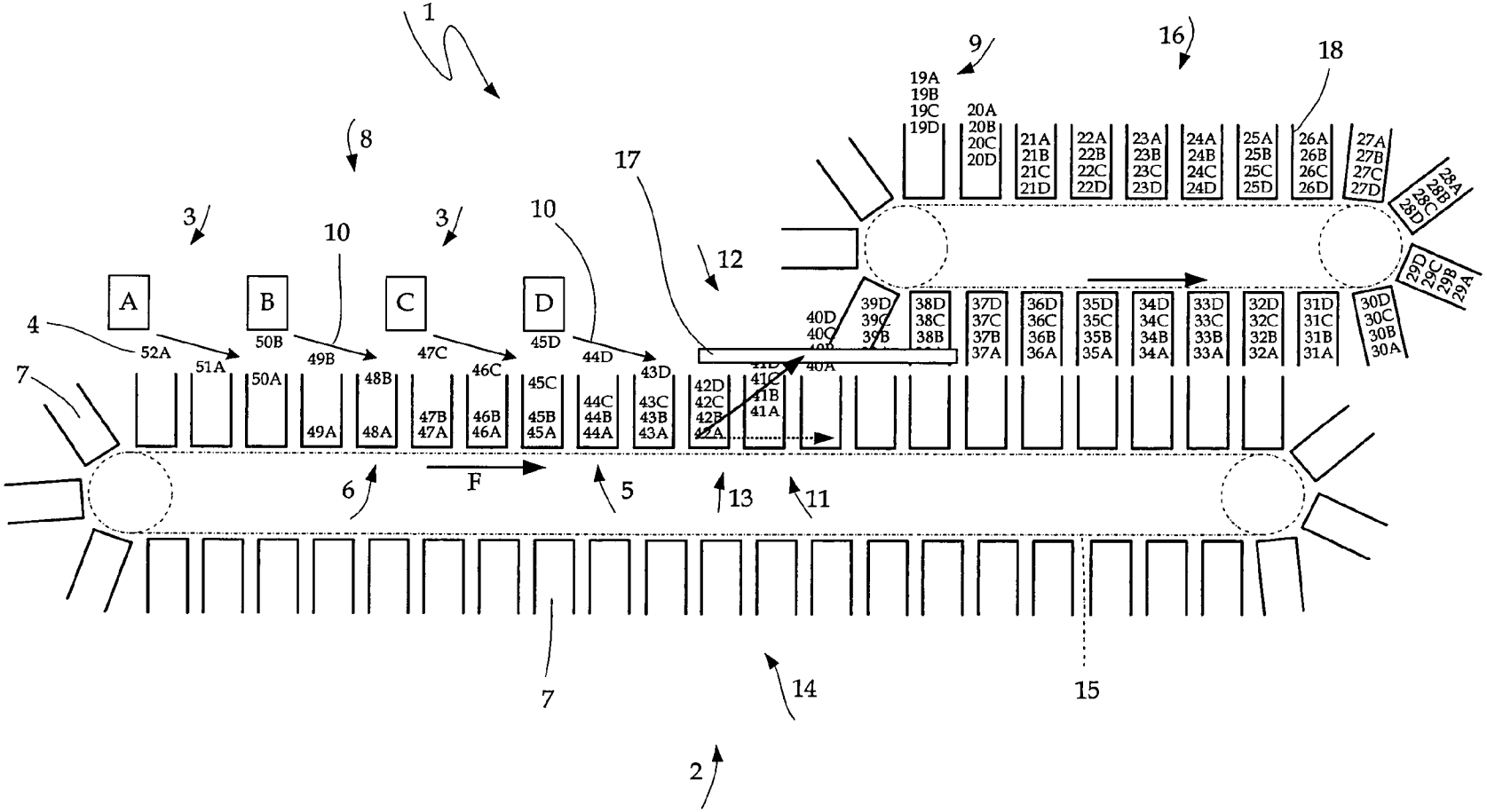
FIG. 7 shows a book production line with an alternative design of the gluing machine in the transfer zone.

The conveying device 2 has a transfer zone 11 that follows downstream of the conveying line 6 in the direction of the gluing machine 16. In this transfer zone 11, complete book blocks 5 that are free of defects are transferred from the receiving devices 7 into the gluing machine 16, so that the spines of the book blocks 5 in the gluing machine 16 are processed and bound by the book spine processing stations arranged in succession in the direction of processing and then delivered to downstream processing machines. A controllable deflector 13 is installed at the beginning of the transfer zone 11, which selectively deflects book blocks 5 towards a conveyance device 12 of the gluing machine 16 or leaves them in the receiving devices 7 of the conveyance device 2. Defective book blocks 5, for example, those with more than one printed product 4 of the same type or incomplete book blocks, can be discharged by means of a discharge deflector (not shown), which preferably is installed between the last feeder 3 in the direction of conveyance F and the deflector 13. Control units 20, 21 are provided for controlling the gathering machine 8 and the gluing machine 16, respectively. They are connected with each other for data exchange, either directly or through a higher-order control unit 22. The control unit 20 of the gathering machine 8 controls, for example, each individual feeder 3, the discharge deflector and the deflector 13. The control unit 21 controls the gluing machine with its book spine processing stations and the associated conveyance devices of the book blocks 5. To this end, the control units 20, 21 continuously receive input signals from sensors on the machines or control commands of the operating personnel. During the transfer of the book blocks 5 from the receiving devices 7 into the gluing machine 16, the receiving devices 7 and the conveyance device 12 of the gluing machine 16 must be exactly aligned with each other or guided on two parallel paths and driven at the same speed. It is not essential to the method of the invention whether the conveyance device 12 is formed by conveying clamps 18 necessary for conveyance during processing in the gluing machine 16 or by a conveyance device 17 that is arranged upstream of the conveying clamps 18 and is part of the gluing machine 16. This type of design of the gluing machine 16 is illustrated in FIG. 7.

FIG. 1 also shows the flow of material during undisturbed production. The different types of printed products 4 to be gathered are designated with the letters A, B, C, and D, and the loose book blocks 5 and printed products 9 are designated with serial numbers. For example, 45A denotes the printed product 4 of type A, which, together with the printed products 45B, 45C, and 45D, forms the loose book block 5 with serial number 45.

Figure 2:
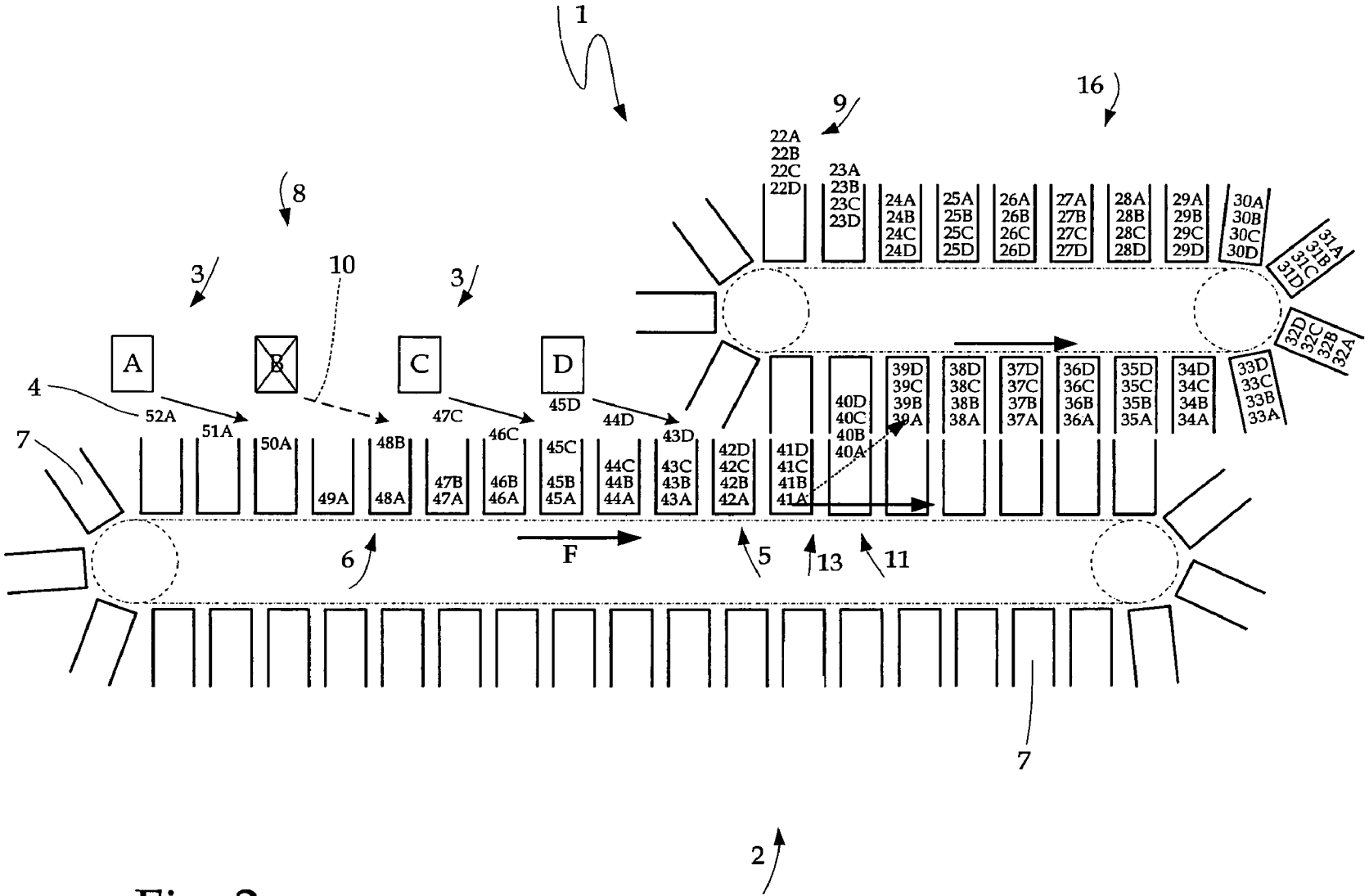
FIG. 2 shows the book production line according to FIG. 1 shortly after the occurrence of a failure in a feeder.
Figure 3:
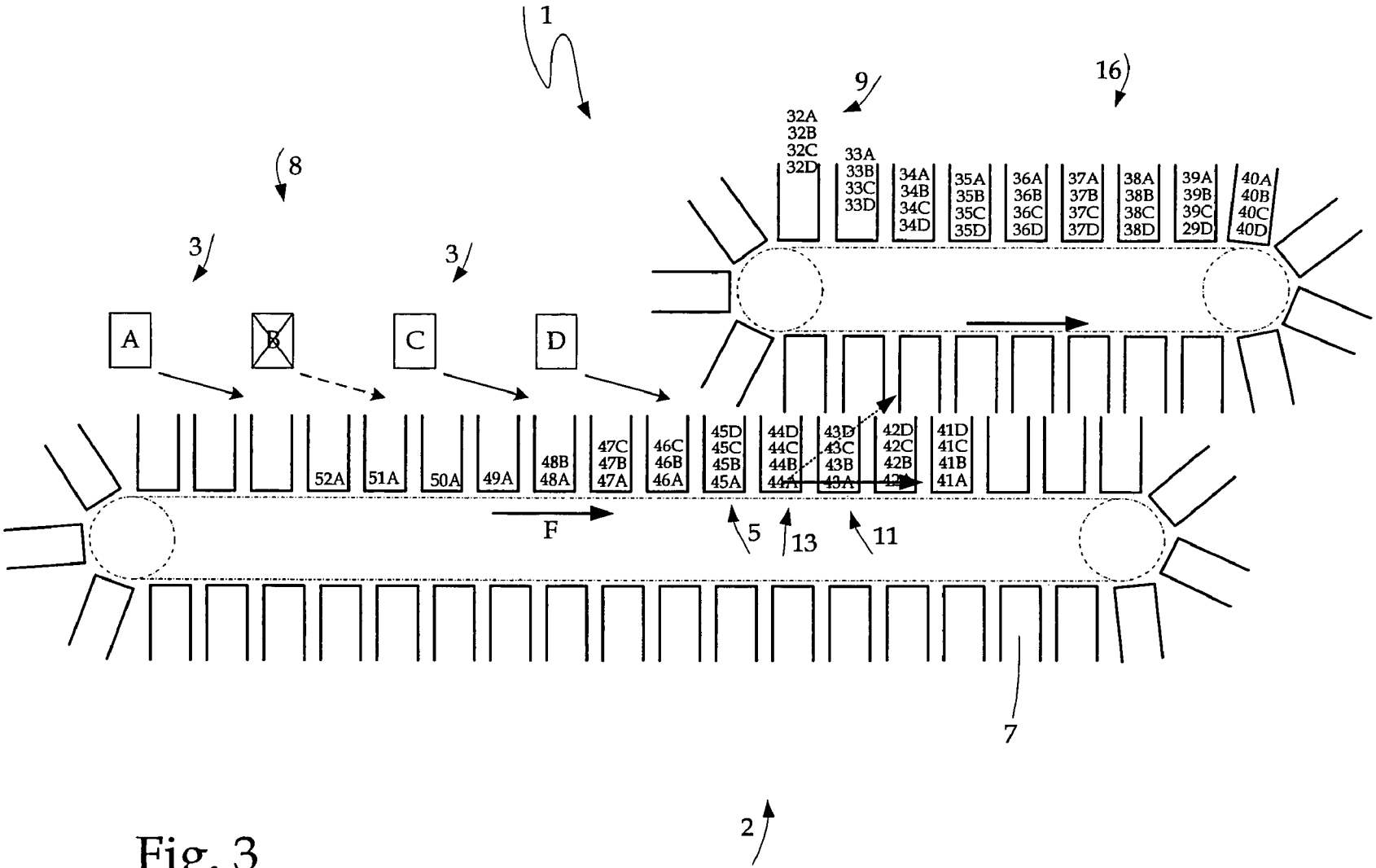
FIG. 3 shows the book production line according to FIG. 2 with the gathering machine stopped and the gluing machine emptying.

FIG. 2 shows the situation of the loose book blocks 5 after a disruption at the feeder 3 of printed product type B. After the printed product with the identification number 48B was fed, a failure occurred at feeder 3 for the printed product type B. The next printed products 49B and beyond are no longer fed. A disruption of this type can occur, for example, if a printed product 4 was damaged or was not properly inserted in the magazine of the feeder 3 or if a technical breakdown has occurred. Missing, extra, or incorrectly inserted printed products 4 can be detected by optical, capacitive, or mechanical sensors and reported to the control unit 20 of the gathering machine 8. In the case of sporadic failures, the affected book blocks 5 can be discharged, so that a shutdown of the gathering machine 8 can be avoided. In the event of continual failure, the gathering machine 8 must be automatically stopped by the control unit 20 and the problem eliminated with the gathering machine 8 stopped. Provision is also made for the operator to be able, if necessary, to stop the gathering machine 8. Stopping the line that comprises the gathering machine 8 and the gluing machine 16 would have the result that all of the book blocks 5 whose spines have been glued but which have not yet been provided with a cover become defective printed products due to the setting of the glue and therefore must be discharged. Therefore, it makes sense to stop the gathering machine 8 and to continue to operate the gluing machine 16 until the last printed product 9 in the gluing machine 16 has been finished. To this end, first the transfer of loose book blocks 5 from the conveyance device 2 to the conveyance device 12 of the gluing machine 16 is interrupted by the deflector 13. At least as long as loose book blocks 5 are present in the transfer zone 11, the conveyance device 2 and the gluing machine 16 must run synchronously with each other. As soon as the last loose book block (in FIG. 2, for example, the book block with serial number 40) has been completely transferred to the conveyance device 12, the synchronism of the gathering machine 8 with the gluing machine 16 can be discontinued or the gathering machine 8 can be braked to a stop. Discontinuance of the synchronism before this time would lead to collisions of the book blocks 5 in the transfer zone 11 with the conveyance device 2 and/or the conveyance device 12 of the gluing machine 16. Immediately after a stop of the gathering machine 8 has been triggered, the feeding of printed products 4 to all of the feeders 3 is also interrupted, so that after the gathering machine 8 has been stopped, printed products 4 are no longer present in the area of the conveyor 10 between the feeders 3 and the conveyance device 2.

Figure 5:
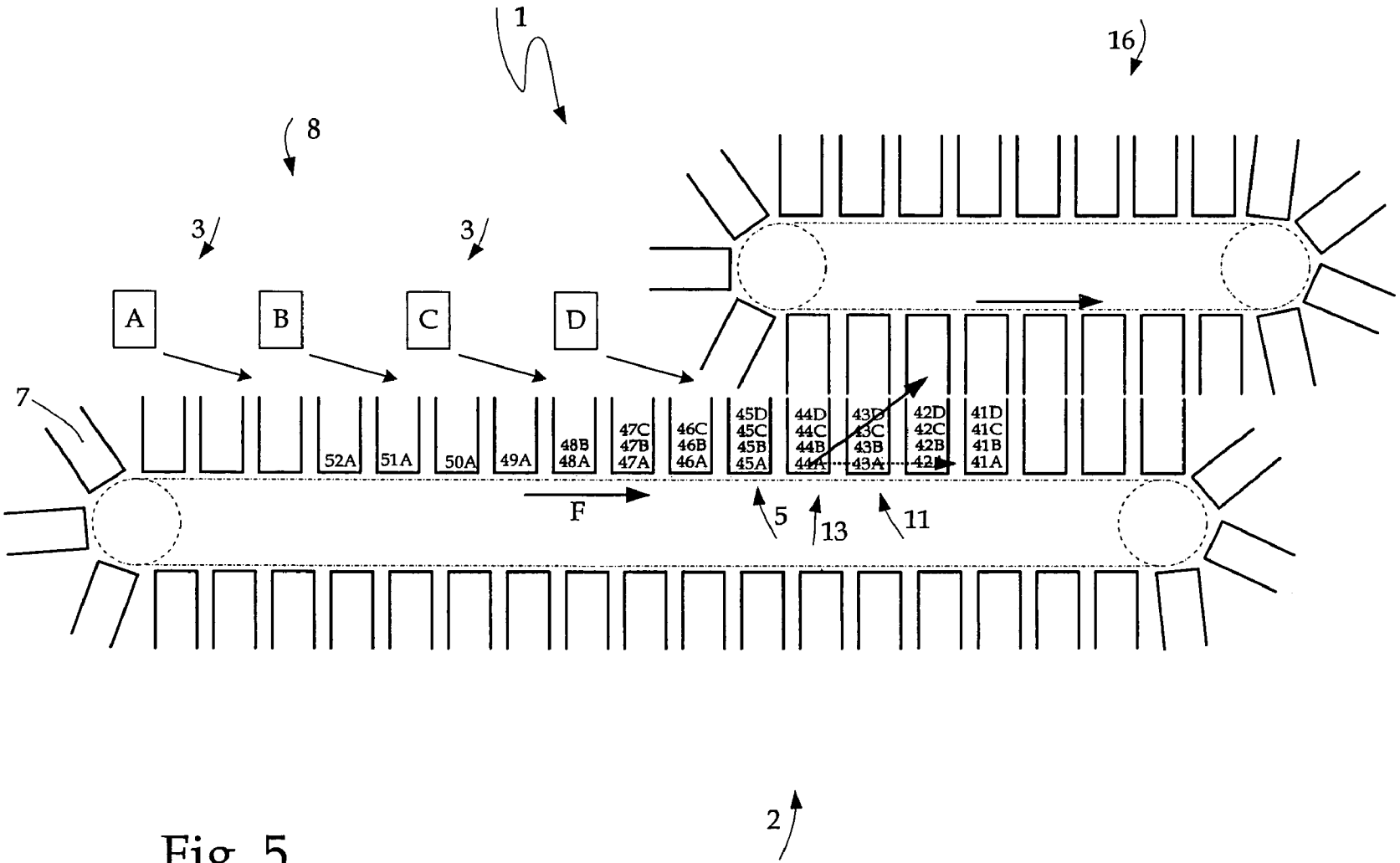
FIG. 5 shows the book production line according to FIG. 3 in the starting position after elimination of the failure by an alternative method.

FIG. 5 shows the resulting situation of the book blocks 5. The gathering machine 8 is stopped, and the synchronism between the gathering machine 8 and the gluing machine 16 has been discontinued. The gluing machine 16 continues to operate at least until the printed product 9 with serial number 40 has been finished. The gluing machine 16 can then continue to run at a very low speed and without products. The book blocks 5 with the serial numbers 41 to 43, which are no longer being transferred to the gluing machine 16, are located downstream of the deflector 13. As soon as the gathering machine 8 has come to a stop, the problem at the feeder 3 can be corrected by the operating personnel.

Figure 4:
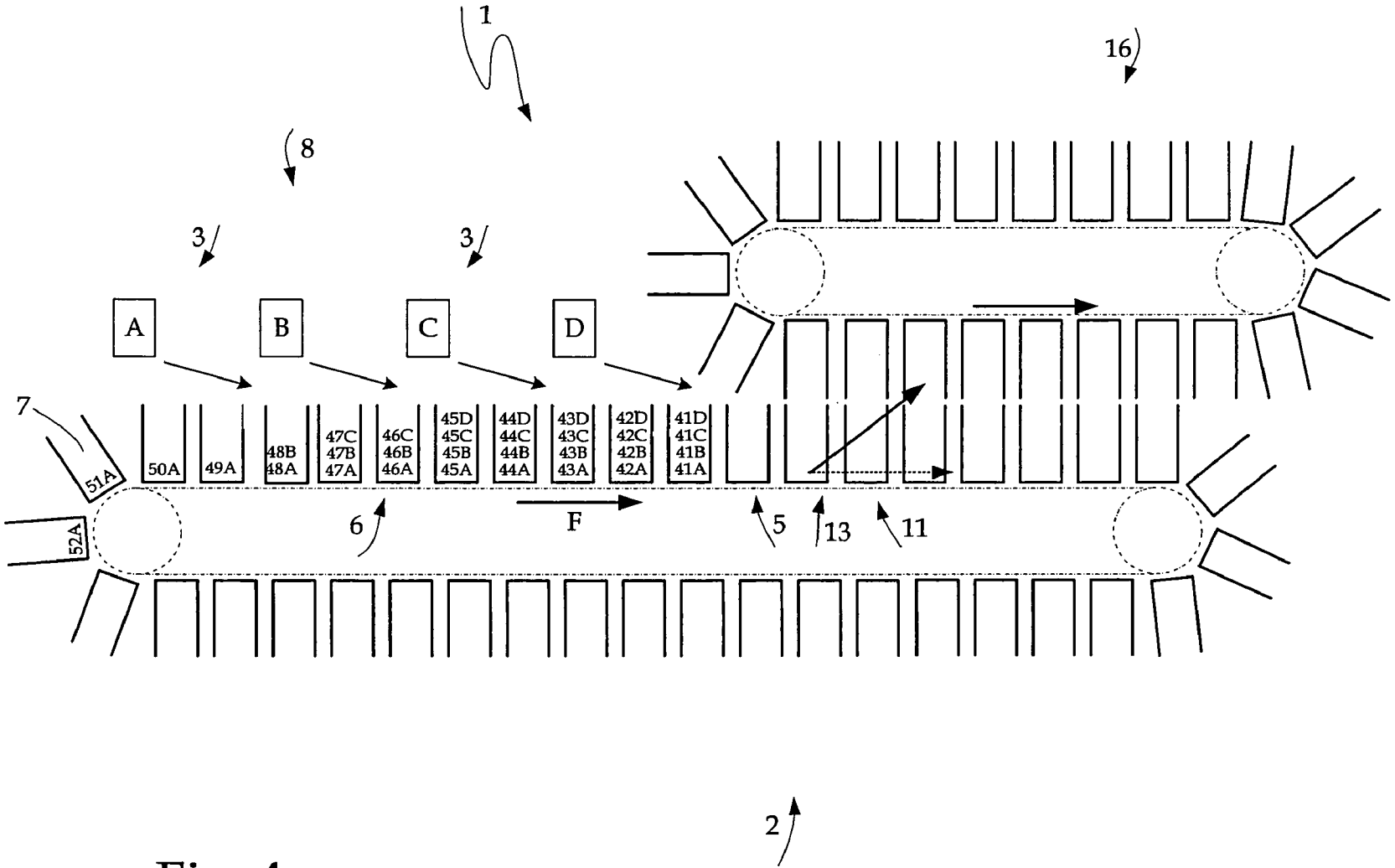
FIG. 4 shows the book production line according to FIG. 3 in the starting position after elimination of the failure.

After the disruption has been eliminated and the gathering machine 8 is ready for operation again, various sequences for continuing production are possible. If the production series that was originally planned is to be continued, then the receiving devices 7, which contain only some of the printed products 4 necessary for a complete printed product 9, must be shifted upstream towards the feeders 3 sufficiently far that during the next pass of the receiving devices 7 past the conveyors 10 of the feeders 3, the missing printed products can be supplied. This would make sense, for example, if the printed products 9 are assigned to a specific addressee and/or to a specific postal route. This state can be reached by moving the entire gathering machine but at least the conveyance device 2 into the position shown in FIG. 4. It is not important whether the gathering machine 8 or the conveyance device 2 is moved into the illustrated position in the direction of conveyance F or in the opposite direction. If only the conveyance device 2 is moved, the feeders 3 and the conveyance device 2 must be resynchronized with each other before production is resumed. After synchronization of the gathering machine 8 with the gluing machine 16 or vice versa, production can be resumed at the point of interruption, and to this end the deflector 13 is switched into the upward direction shown in FIGS. 1 to 7.

Figure 6:
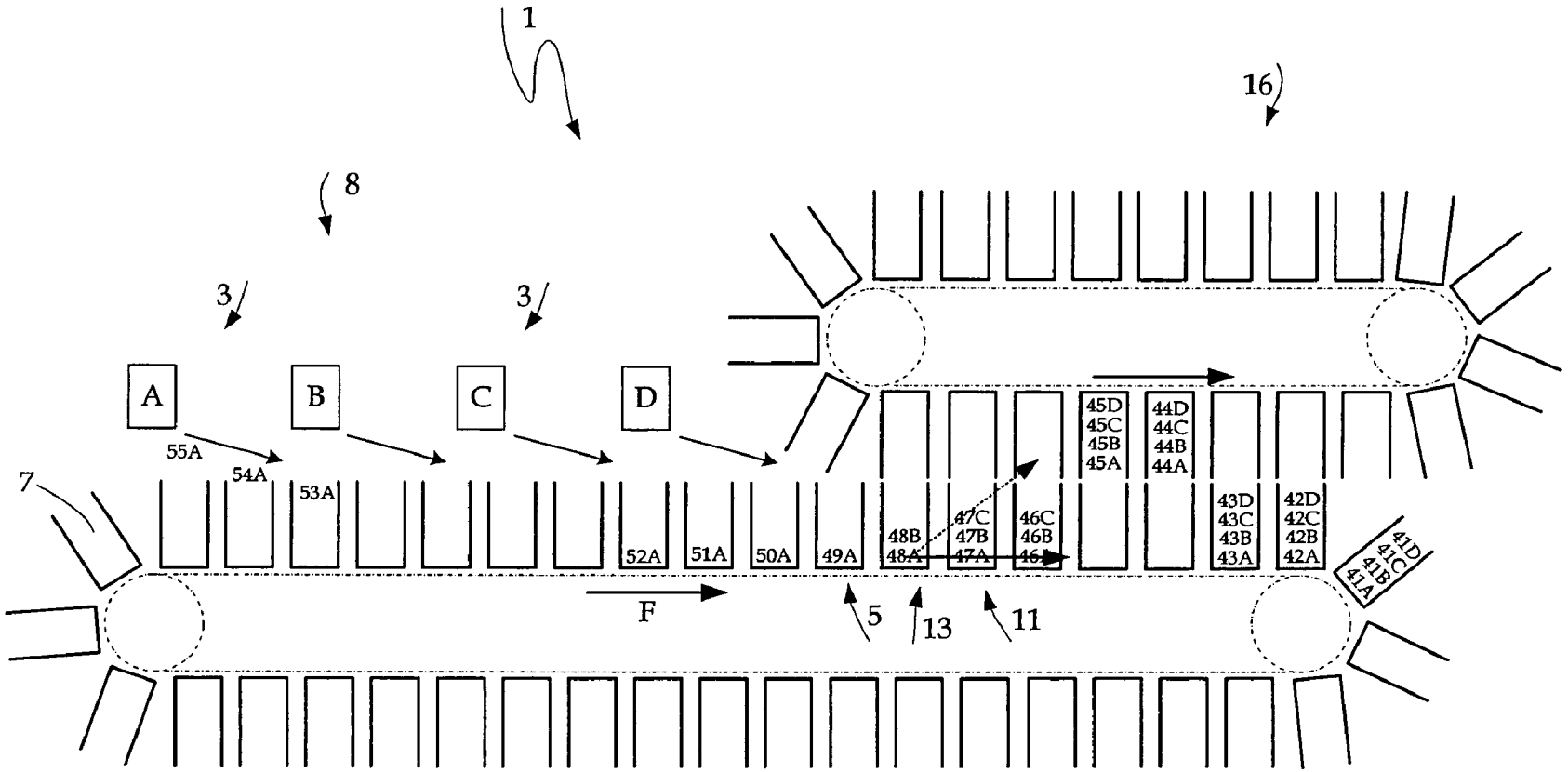
FIG. 6 shows the book production line according to FIG. 5 after the start.

If all of the printed products 9 of a production run are identical, the order in which the printed products 9 are produced is not important. In this case, it is possible, starting from the situation shown in FIG. 3, to synchronize the gathering machine 8 with the gluing machine 16 and to operate the deflector 13 in such a way that complete book blocks 5 that are still located upstream of the deflector 13 are transferred into the gluing machine 16 and incomplete book blocks 5 are left in the receiving devices 7 of the conveyance device 2. FIG. 5 shows the state in which the gathering machine 8 and the gluing machine 16 are synchronized again or are moving synchronously. The complete book blocks 5 with the serial numbers 41 to 43 are located downstream of the deflector 13 and thus cannot be transferred directly into the gluing machine 16 but rather only during the next passage. The complete book blocks 5 with the serial numbers 44, 45 are located upstream of the deflector 13 and are transferred into the gluing machine 16, while the incomplete book blocks 5 with the serial numbers 46 to 52 remain in the receiving devices 7 of the gathering machine 8. FIG. 6 shows the state after the complete book blocks 5 with the serial numbers 44, 45 have been transferred into the gluing machine 16, while the incomplete book blocks 5 that follow them remain in the receiving devices. The incomplete book blocks 5 are completed the next time they pass by the feeders 3. The overall coordination of the feeders 3, which transfer printed products 4 into the receiving devices 7, is carried out by the control unit 20 of the gathering machine 8.

While specific embodiments of the invention have been described in detail to illustrate the inventive principles, it will be understood that the invention may be embodied otherwise without departing from such principles.

We claim:

1. A method of producing perfect-bound printed products formed from several printed products, the method comprising feeding the printed products, which are gathered to form loose book blocks, by means of feeders, which are arranged along a gathering line and are driven at least approximately with synchronous timing, to a conveyance device, the conveyance device having receiving devices that follow one another at regular intervals and are guided on a closed revolving track, and transferring the printed products by this conveyance device into a gluing machine, wherein a switchable deflector is installed in a transfer zone between the conveyance device and the gluing machine wherein, in the event of an interruption of a processing operation, the gluing machine, arranged downstream of the conveyance device and having a conveying function, continues to operate at least until a last printed product in the gluing machine is finished, further comprising, while the gluing machine is emptying, stopping further feeding of printed products to the receiving devices of the conveyance device and further feeding of loose book blocks to the gluing machine, wherein during the interruption of the processing operation the book blocks at a beginning of a transfer zone are no longer deflected by a deflector toward the gluing machine.

2. The method in accordance with claim 1, wherein, while feeding of the loose book blocks into the gluing machine is discontinued, the loose book blocks remain in the conveyance device and are further transported until the book blocks are downstream of the deflector and synchronization with the gluing machine can end.

3. The method in accordance with claim 2, wherein the conveyance device continues to be run synchronously with the gluing machine until the last book block intended for the gluing machine has been transferred, and stopping the conveyance device after completion of the transfer of the last book block.

4. The method in accordance with claim 3, comprising, after the conveyance device has been stopped, moving the conveyance device into a position for the resumption of production.

5. The method in accordance with claim 4, comprising moving the conveyance device in the direction of conveyance (F).

6. The method in accordance with claim 4, comprising moving the conveyance device in the direction opposite the direction of conveyance (F).

7. The method in accordance with claim 4, comprising completing the incomplete book blocks with the missing printed products when production is resumed.

8. A book production line for producing perfect-bound printed products formed from several printed products, the book production line comprising a gathering machine composed of a conveyance device and of feeders arranged along a gathering line of the conveyance device and which has receiving devices for receiving printed products from the feeders as they pass the feeders, the receiving devices being guided on a closed revolving track, and a gluing machine arranged downstream of the conveyance device and also having a conveying function, and have conveying clamps driven parallel to the conveyance device and to which the loose book blocks conveyed by the conveyance device are transferred, wherein a switchable deflector is installed in a transfer zone between the conveyance device and the gluing machine, wherein during an interruption of a processing operation the gluing machine remains operative until a last printed product in the gluing machine is finished, wherein the deflector is switched during the interruption of the processing operation so as to no longer deflect the book blocks toward the gluing machine.

9. A book production line in accordance with claim 8, with a gluing machine that has book spine processing stations arranged in succession in the direction of processing, wherein the deflector opens into the gluing machine upstream of the spine processing stations.

* * * * *